United States Patent [19]

Pinckaers et al.

[11] 4,222,046

[45] Sep. 9, 1980

[54] ABNORMAL CONDITION RESPONSIVE MEANS WITH PERIODIC HIGH SENSITIVITY

[75] Inventors: B. Hubert Pinckaers, Edina; Stephen A. Haglund, Minnetonka, both of Minn.

[73] Assignee: Honeywell, Inc., Minneapolis, Minn.

[21] Appl. No.: 929,488

[22] Filed: Jul. 31, 1978

[51] Int. Cl.[2] ..... G08B 17/10

[52] U.S. Cl. ..... 340/629; 250/381

[58] Field of Search ..... 340/628, 629, 630; 250/574, 381, 382, 384, 385

[56] References Cited

U.S. PATENT DOCUMENTS

| | | | |
|---|---|---|---|
| 3,295,121 | 12/1966 | Meyer | 250/381 |
| 3,407,299 | 10/1968 | Jehle | 250/375 |
| 3,657,737 | 4/1972 | Hamm et al. | 340/629 |
| 3,725,660 | 4/1973 | Doherty | 340/578 X |
| 3,728,703 | 4/1973 | Burnett | 250/381 |
| 3,849,685 | 11/1974 | Larsen | 250/381 X |
| 3,872,449 | 3/1975 | Scheidweiler | 340/629 |

*Primary Examiner*—John W. Caldwell, Sr.
*Assistant Examiner*—Daniel Myer
*Attorney, Agent, or Firm*—Clyde C. Blinn; Henry L. Hanson

[57] ABSTRACT

An ionizing type smoke detector device has an output voltage which is compared with a reference voltage and upon the output dropping below the reference, a horn is energized. The reference voltage is normally quite low to reduce the number of false alarms and thus the smoke detector is relatively insensitive to smoldering fires which may require a high sensitivity of the smoke detector device. A timer means periodically modifies the reference voltage to a high value for a short period of time to make the smoke detector more responsive to smoldering fires and yet with the higher sensitivity for the short period of time the number of false alarms are kept at a minimum. Additionally a counter circuit is provided for counting the outputs of the smoke detector over three timing periods and if an output exists for three consecutive periods, an output to the horn is provided.

8 Claims, 1 Drawing Figure

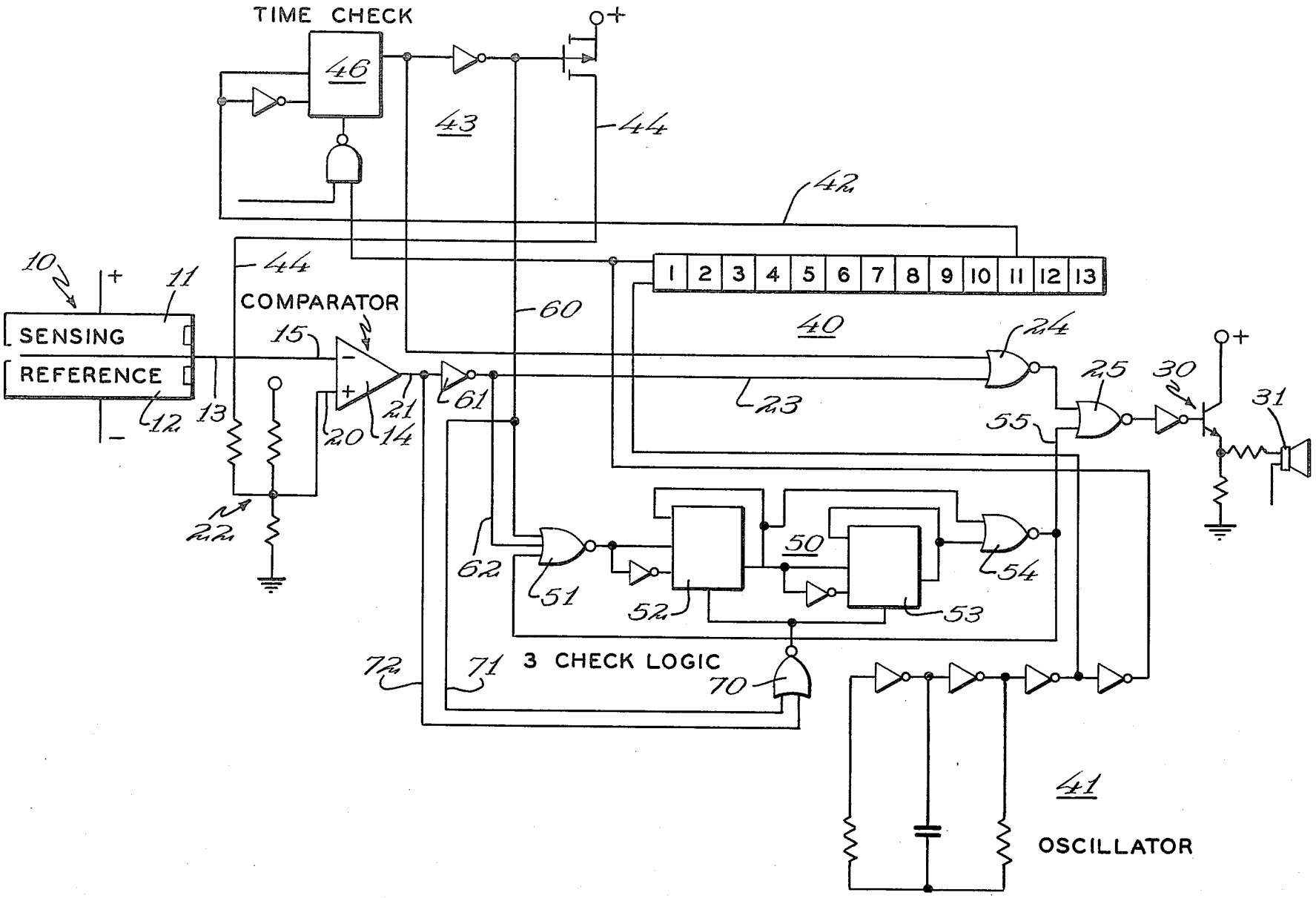
TIME CHECK
COMPARATOR
SENSING
REFERENCE
3 CHECK LOGIC
OSCILLATOR

ABNORMAL CONDITION RESPONSIVE MEANS WITH PERIODIC HIGH SENSITIVITY

BACKGROUND OF THE INVENTION

Field of the Invention

Abnormal condition responsive devices such as ionization or photoelectric smoke detectors can be set to be highly sensitive so that with a smoke detector the detection of a smoldering fire can be made. With such a highly sensitive smoke detector, the number of false alarms which might be brought about by other conditions, whether it is in the detector or in the circuit, greatly increases with the highly sensitive detection device. On the other hand, if the sensitivity is low, a smoldering type fire can go undetected for a considerable period of time resulting in a buildup of a highly dangerous condition.

SUMMARY OF THE INVENTION

The present invention is concerned with an abnormal condition responsive device or smoke detector wherein the sensitivity of the responsive device is periodically increased for a short period of time to make the device more sensitive to smoldering fires and yet during a greater portion of the operation time the sensitivity is quite low to minimize the possibility of false alarms. In order to provide the invention, a timing device periodically modifies the reference signal level needed to produce an alarm so that the sensing device has a high sensitivity for short periods of time. Additionally, during the high sensitivity period of time, the presence of an output signal is stored and if three successive output signals are provided with the high sensitivity period response, an output to the horn or annunciator is provided.

BRIEF DESCRIPTION OF THE DRAWING

The single FIGURE is a schematic representation of the abnormal condition responsive device.

BRIEF DESCRIPTION OF THE PREFERRED EMBODIMENT

Referring to FIG. 1, the abnormal condition responsive device has a condition responsive sensor means or ionization chamber smoke detector 10 of the type shown in the Larry D. Larsen U.S. Pat. No. 3,849,685, issued Nov. 19, 1974. A sensing chamber 11 which is open to the atmosphere and a reference chamber 12 which is closed provide a voltage divider so that the voltage with respect to ground on electrode 13 varies with the intensity of the smoke in sensing chamber 11. A comparator or amplifier 14 has a signal voltage input 15, a reference voltage input 20 and an output 21. When the signal input voltage at 15 from sensor 10 drops to the reference voltage input, an output at 21 is available.

The normal or low level of sensitivity reference voltage signal or input is established by voltage divider 22. When the output of the ionization chamber 10 on input 15 compares with the normal reference voltage on input 20 established at 22, comparator 14 provides an output over a conductor 23 to gates 24 and 25 and a switch 30 to energize the annunciator or horn 31. The sensitivity of detector circuit as established by a low reference voltage at 22 for the normal operation is low to provide ionization chamber 10 which responds only to large magnitudes of smoke level to maintain the number of false alarms at a reasonable minimum. When the sensitivity of the circuit is high, various conditions both in the ionization chamber 10 and the circuit to which the ionization chamber is connected can result in the enerization of horn 31 when there is no smoke in the ionization chamber 10, causing a nuisance to the homeowner. The level of the reference voltage for the normal operation as established at 22, is set as a compromise between the level of sensitivity of ionization chamber 10 and the occurrence of nuisance or false alarms.

A conventional digital timer means 40 which is energized by a conventional oscillator circuit 41, provides for a short time pulse such as 10 to 100 milliseconds over conductor 42 at predetermined intervals such as one minute. The timing pulse is then placed on the input of the switching circuit 43 including a D type flip-flop circuit 46 similar to that described in the handbook *COS/MOS Integrated Circuits Manual* of the RCA Technical Series CMS-271, copyright 1972. The circuit identification is RCA CD4013 or equivalent, which is connected to apply a voltage over circuit 44 to the voltage divider 22 to modify the reference voltage applied to the reference input 20. When the pulse from the timing circuit occurs, the reference voltage established by the voltage divider 22 is modified and a higher level of voltage is applied to reference electrode 20 and a high level of sensitivity is established for a short time period. Ionization chamber 10 then responds to low magnitudes of smoke level and thus is more responsive to smoldering fire conditions.

A check logic circuit 50 has a NAND gate 51, at least two flip-flop circuits 52 and 53 (similar to 46) and a NAND gate 54. Circuit 50 upon receiving an input pulse from gate 51 activates flip-flop 52 and upon receiving a subsequent pulse, activates flip-flop circuit 53 until upon receiving the third pulse an output is provided over gate 54 to energize horn 31 through a circuit 55. When the switching circuit 43 is energized to modify the sensitivity of the detector to the high sensitivity, simultaneously a pulse is transmitted over circuit 60 to an input of gate s1 to activate the circuit 50. If an alarm output at 21 is provided when the high sensitivity reference voltage is applied to the comparator circuit 14, the output after passing through the inverter 61 is applied over circuit 62 to a second input of gate 51. When the simultaneous output over 60 and 62 are applied to gate 51, the first flip-flop 52 is activated. Subsequently upon a second output from the comparator and the pulse over 60, the second flip-flop 53 would be energized until upon receiving three simultaneous pulses indicating three abnormal conditions at detector 10, the output of circuit 50 would energize horn 31.

A reset gate 70 has a first input from the pulse circuit 60 over conductor 71 and second input from the output of comparator 14 over circuit 72. When these input are both available, the reset circuit is not activated; however, if a pulse over circuit 60 occurs and no abnormal condition is sensed by detector 10 to provide an output of the comparator 14, the reset circuit 70 is activated to reset the counting circuit 50 back to zero. The reset circuit then provides that the counter circuit 50 must receive three consecutive pulses of a low level abnormal condition of detector 10 before the annunciator or horn 31 is energized.

DESCRIPTION OF THE OPERATION OF THE PREFERRED EMBODIMENT

Under normal operation with a low level of sensitivity, smoke detector 10 operates in a normal manner in that when an output over electrode 13 drops to a predetermined reference value as established by the voltage on reference electrode 20, the comparator amplifier 14 provides an output over circuit 23 to energize the annunciator or horn 31. As the level of output over electrode 13 of detector 10 varies with the amount of smoke contained in chamber 11, with the low level of sensitivity as established by the reference voltage at 22, the number of false alarms due to other conditions will be maintained at a minimum.

To make the ionization chamber 10 responsive to smoldering fires which requires a detector having a high level of sensitivity, it would be possible to increase the sensitivity by the reference voltage at 22; however, with a constant high level of sensitivity the number of false alarms which provide quite a nuisance to the homeowner would greatly increase.

By means of the timer 40, each minute, a 15 millisecond pulse is placed over conductor 42 to activate the switching circuit 43. During this pulse, the counting circuit 50 is energized over conductor 60 to make it acceptable to the output of the comparator if an abnormal condition exists during that pulse. At the same time, a voltage is applied over circuit 44 to modify the reference voltage at electrode 20 to establish a high level of sensitivity for the detector 10. If during the time of the 15 millisecond pulse, the smoke condition in the sensing chamber 11 is low which might be the case with a smoldering fire, an output is provided and the output is applied to the counting circuit over circuit 62. If upon three subsequent timing pulses over the next two minutes there is an output from the ionization chamber 10, the three outputs will be counted by circuit 50 and an output to horn 31 will provide a horn operation indicative of the smoldering fire condition.

Not only does the present invention provide for a high level of sensitivity at ionization chamber 10 to respond to smoldering fires, but the assurance that a smoldering fire condition is taking place over a timing period is provided by requiring at least three subsequent outputs at the high level sensitivity of ionization chamber 10 before the annunciator or horn can be energized.

The embodiments of the invention in which an exclusive property or right is claimed are defined as follows:

1. In a condition responsive device having a high sensitivity for detection of abnormal conditions and having an acceptable tolerance to false alarms, comprising condition responsive means having a first ouput signal upon the presence of a predetermined level of a condition, reference signal means having a reference output signal varying with the desired level of said condition for providing an alarm, comparator means connected to receive said first output signal and said reference output signal for instantaneously comparing said signals and providing an alarm output signal when said first output signal compares with said reference output signal, annunciator means connected to said comparator means for responding to said alarm output signal, and means connected to said reference signal means for changing said reference output signal, said reference output signal having a first normal value whereby said comparator means is responsive to conditions of large magnitudes and false alarms are minimized and having a second short periodic value whereby said comparator means is responsive to conditions of small magnitudes.

2. The invention of claim 1 wherein, said condition responsive means is a smoke detector for detecting the presence of smoke in the air of a space, and said reference output signal having said second value for several millisecond periods each several minutes to make the smoke detector responsive only to large levels of smoke most of the time and responsive to small levels of smoke indicative of smoldering fire conditions during said millisecond periods.

3. The invention of claim 2 wherein said means connected to said reference signal means is a timer means to periodically change the value of said refernce output signal.

4. The invention of claim 3 wherein said timer means provides for a reference output signal to have said annunciator respond periodically to a small level of smoke.

5. The invention of claim 2 wherein said smoke detector comprises an ionization chamber for providing said first output signal when smoke is in said chamber.

6. The invention of claim 2 comprising counting circuit member responsive to said alarm output signal to provide for operation of said annunciator means only after three consecutive alarm output signals, having a first time period therebetween, are received by said annunciator means.

7. The invention of claim 6 wherein said counting circuit means is activated each of said millisecond periods when an alarm output signal exists with means to reset said counting means to zero when an alarm output signal does not exist for a predetermined time period longer than said first time period.

8. An improvement in a detector alarm device having a condition responsive means and a reference means connected by a comparator means to an annunciator means wherein the sensitivity of the condition responsive means determines the number of false alarms and to reduce the number of false alarms, the sensitivity is maintained at a low level by the output of the reference means, the improvement comprising, timer means, and means connected to said timer means to periodically modify the output of said reference means to change the sensitivity of the responsive means to a high level of sensitivity to respond to low levels of condition but by maintaining the total percentage of time for high level sensitivity small enough to maintain the false alarms to an acceptable level.

* * * * *